US010532394B2

(12) United States Patent
Davoodi et al.

(10) Patent No.: US 10,532,394 B2
(45) Date of Patent: Jan. 14, 2020

(54) PORTABLE, COMPACT AND AUTOMATED CAGE MAKING MACHINE

(71) Applicants: Omid Davoodi, Shiraz (IR); Ahmad Gholami, Shiraz (IR); Elham Zamani, Shiraz (IR)

(72) Inventors: Omid Davoodi, Shiraz (IR); Ahmad Gholami, Shiraz (IR); Elham Zamani, Shiraz (IR)

( * ) Notice: Subject to any disclaimer, the term of this patent is extended or adjusted under 35 U.S.C. 154(b) by 293 days.

(21) Appl. No.: 15/437,421

(22) Filed: Feb. 20, 2017

(65) Prior Publication Data

US 2018/0236527 A1 Aug. 23, 2018

(51) Int. Cl.
*B21F 27/12* (2006.01)
*E04C 5/06* (2006.01)

(52) U.S. Cl.
CPC ..... *B21F 27/122* (2013.01); *E04C 5/0622* (2013.01)

(58) Field of Classification Search
CPC ..... B21F 27/122; E04C 5/0618; E04C 5/0622
See application file for complete search history.

(56) References Cited

U.S. PATENT DOCUMENTS

| | | | | |
|---|---|---|---|---|
| 2,992,750 A * | 7/1961 | Brock | B60P 1/52 298/5 |
| 5,215,426 A * | 6/1993 | Bills, Jr. | B60P 1/43 414/537 |
| 5,665,254 A * | 9/1997 | Isono | B21F 27/124 140/112 |
| 6,223,785 B1 * | 5/2001 | Barden | B21F 27/124 140/112 |
| 6,925,705 B2 * | 8/2005 | Neckoula | B21F 27/124 29/700 |
| 2004/0020033 A1 * | 2/2004 | Neckoula | B21F 27/124 29/703 |
| 2009/0108562 A1 * | 4/2009 | Hagenbuch | B60P 3/062 280/407.1 |

* cited by examiner

*Primary Examiner* — Ryan J. Walters
(74) *Attorney, Agent, or Firm* — Azadeh Saidi

(57) ABSTRACT

The invention is an automated machine for reinforcement of piles, pillars, beams, and reinforcing cages in location of construction projects. This machine consists of main elements like loading arms and feeding jaws of longitudinal bars, rotating winch for stirrup and its guides, fixed and moving jaws and welding robot. It can be installed on a specified flat trailer in resting mode and come to an operative mode in project location and will be ready to use. To make reinforcing cages, an automated method for continuous winding of stirrup around longitudinal bars has been applied, and two intelligent welding systems (resistive spot and $CO_2$ welding methods) have been utilized for joints in this machine.

11 Claims, 17 Drawing Sheets

PORTABLE, COMPACT AND AUTOMATED CAGE MAKING MACHINE

FIELD OF THE INVENTION

This machine has been invented to produce reinforcing cages automatically in construction projects. In other words, this portable and compact machine has been specifically invented to wind stirrup around rebar, automatically.

BACKGROUND OF THE INVENTION

Reinforcing cages are formed by connecting shaped stirrups around longitudinal bars, which is usually done in traditional manner by labor and considered as time consuming and intolerable activities and required lots of preparation before manufacturing the cages. Furthermore, employing large number of workers who involve making cages in long period, results higher production costs. Moreover, manual producing of cages affected bars with torsion and to some extent bending and the stirrups do not connect to bars firmly and regularly.

Material wastages during production process can be considered as another difficulty. To solve the problems of manual production; many huge machines have been invented for mechanized manufacturing. Various mechanism have been utilized in these kinds of machines, for instance winding stirrup loops around bars or embedding bars into the pre-shaped stirrups by longitudinal movement of bars.

These machines don't have the necessary adaptability in compassion with manual making of reinforcing cages with different shapes and dimensions and various size of re-bars and stirrups, at all. Moreover high weight and massive dimension of these machines cause difficult transportation of them. Therefore, the producers have to assemble the cages at erection point of machine and carry them to construction job site.

Transporting of the cages, may results problems and excess costs in conjunction with quality reduction of joints and even deformation of cage configuration and its elements. Since aforesaid difficulties of these machines exist, utilizing the manual methods is still common in many of construction projects. Wide spread using of automated machines in this field, required new mechanisms that by solving mentioned obstacles, have proper adoptability for manufacturing various kinds of reinforcing cages and also by producing the cages at the job site location, removes problems of transportation of fabricated cages.

SUMMARY OF THE INVENTION

The invented machine is able to reinforcing piles, pillars, beams, and cages efficient and mechanized at location of construction projects by removing previously mentioned problems. Some parts of the machine can be bedded inside of main section with a certain mechanism. The machine in resting mode is installed on a specified flat trailer and opens up to operative mode again in job site location afterwards, so the machine will be ready to operate.

In this portable and compact machine, longitudinal bars are conducted to machine by loading arms and after desired arrangement of re-bars (according to drawings of each project); the stirrups are winded continuously and orderly around bars with a precise computer controlled intervals (stirrup pitch interval) in an automatic manner. A robot also welds contacting joints between stirrups and longitudinal bars.

The invented machine equipped with two fixed and moving jaws which complete reinforcing cage making procedure by keeping moving jaw away from fixed ones. In fact, the function of the machine is based on two movements, rotational and longitudinal, which maintains continuous spiral shaped weaving of stirrup around bars. Two welding methods, resistive and $CO_2$, can be used in this machine to make spot connection.

Spot welding of bars and stirrups is done under the consideration of technical criteria and relevant standards, so this considerations cause higher strength and prevent wasting tensional resistance of bars, so the application of this welding method leads to higher quality and strength and the joints will be identical in comparison with traditional methods.

These properties together with continuity and regularity of stirrups of the cages produced by invented system, increases the quality of cages, which accordingly gain the strength of cages against pressures and forces applied to pillars, piles, beams and reinforcing cages. Furthermore, material wastage (stirrup or steel bar) will be eliminated during the producing steps.

Using large number of workers is not necessary in this method and invented machine is able to execute reinforcement works automatically by fewer operators at a speed more than five times faster than traditional method. The operational speed of machine is considered to be 45 joints per minutes in $CO_2$ welding method or 250 joints per minutes in resistive spot welding.

The automated compact and portable reinforcing machine has the ability of making cages with different shape and dimension. This is able to reinforcing piles, pillars, beams and cages up to 150 centimeters in diameter and standard length of 12 meters. This machine is able to produce triangle square, rectangle, polygon and circular shaped cages. Also it is flexible and compatible to use bars and stirrups with various sizes. The machine is designed in such a manner that works with stirrups with diameters 6 millimeters and up to 12 millimeters; and steel bars of 12 up to 32 millimeters range. Also the capability of using 16 millimeters stirrups has been considered in this machine. In addition, this machine is capable of applying double stirrups for making reinforcing cages with twin strings, depending on the design of the structure, or when thicker stirrups are scarce in the market.

This automated reinforcing machine for piles, pillars, beams and cages can be utilized in many of construction activities like piling in subway projects, road construction, concrete pipe manufacturing, producing electricity light poles and similar projects.

DETAILED DESCRIPTION OF THE INVENTION

Figure 1:
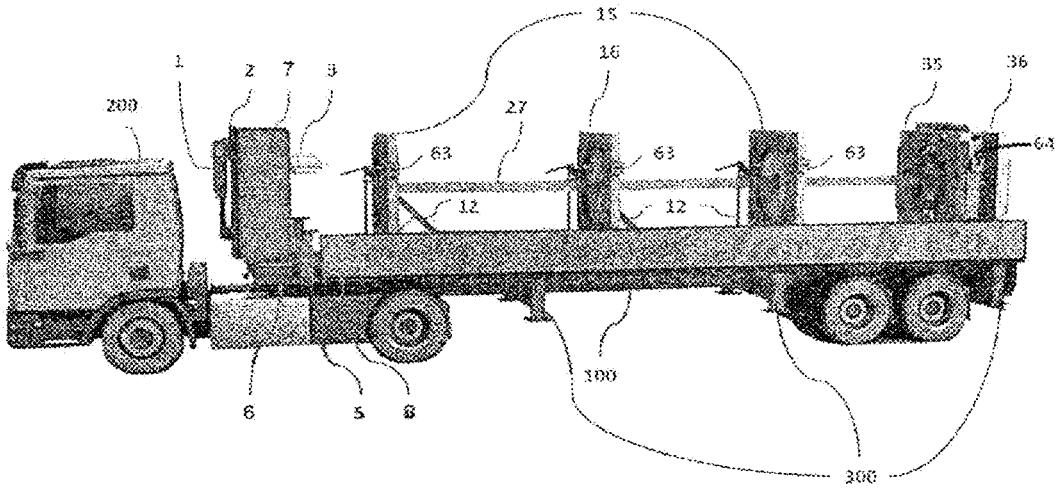
FIG. 1 shows the invented machine mounted on a flat trailer in resting mode.

FIG. 1 shows the invented machine mounted on a flat trailer (100) in resting mode. In this case, trailer (100) containing invented machine, can be transported by a crawler (200) to a particular construction jobsite, for fabricating the reinforcing cage. After bringing the crawler to jobsite, the hydraulic cylinders (300) of trailer will be opened and the crawler (200) can be separated from the trailer. Then central hydraulic system of the machine commands to activate stands (1) which are two hydraulic cylinders connected to frame (2) by a pivot joint.

Figure 2:
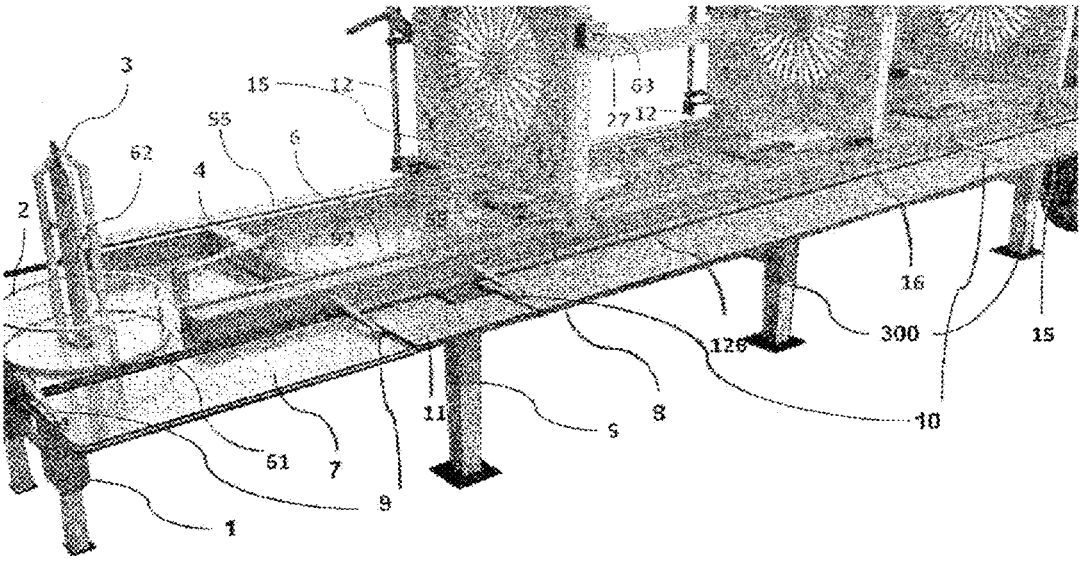
FIG. 2 illustrates the invented machine when the winch is opened.

Therefore these stands will be opened after a 90 degrees rotation and the frame (2), where the winch (3) is mounted on; changes its position from vertical to horizontal by a pivot joint (frame (2) can be moved by hydraulic cylinder (4), as can be seen in FIG. 2). Therefore, the stands (1) with the aid of its hydraulic cylinders lay on the ground. Two stands (5) which are hydraulic cylinders pivoted to main chassis (6), are activated and rotate 180 degrees, so lay on the ground and the machine will be leveled.

According to FIG. 2, two hydraulic cylinders (9) open lateral edge (7) and another three hydraulic cylinders (10), which are located at beginning, middle, and end of lateral edge (8), open lateral edge (8) and form a platform for movement of operators. (A ladder (400) can be used to access the platform, see FIG. 3). Part (11) can slide between (7) and (8) to complete the access way platform.

Figure 3:
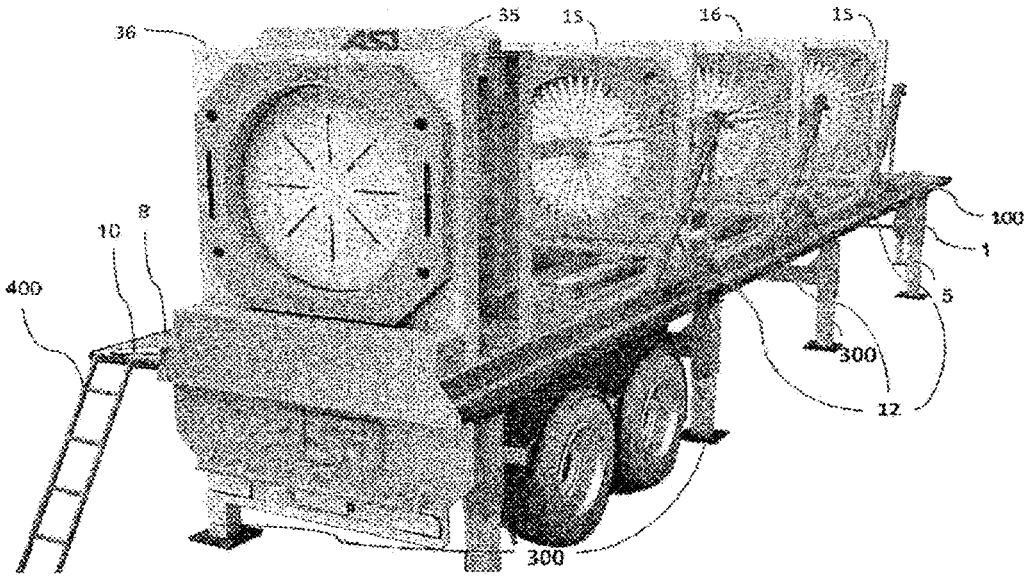
FIG. 3 shows the invented machine, when the loading arms are closed.

FIG. 3 shows the trailer containing the invented machine until previously mentioned preparation step. As it can be seen in this figure, three loading arms (12) that have been designed for carry longitudinal bars into the machine, are located parallel to longitudinal axis of trailer in closed form.

Figure 4:
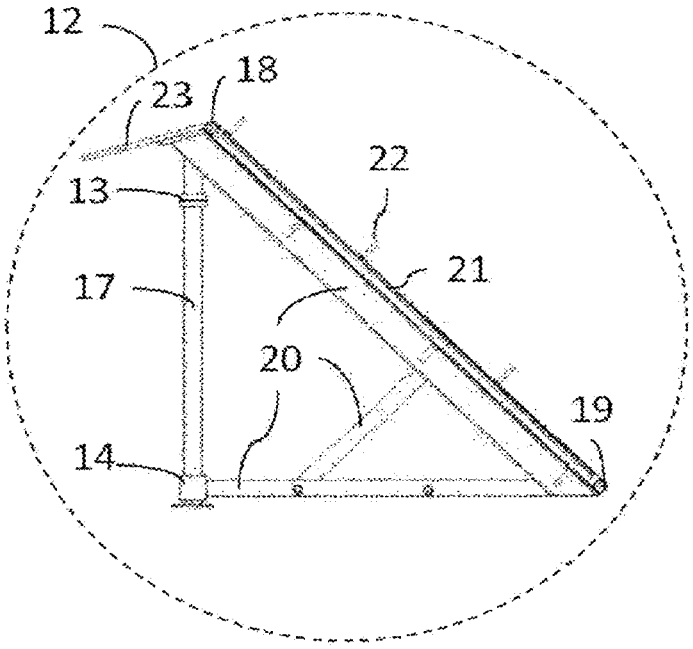
FIG. 4 represents lateral view of loading arms of the invented machine.
Figure 5:
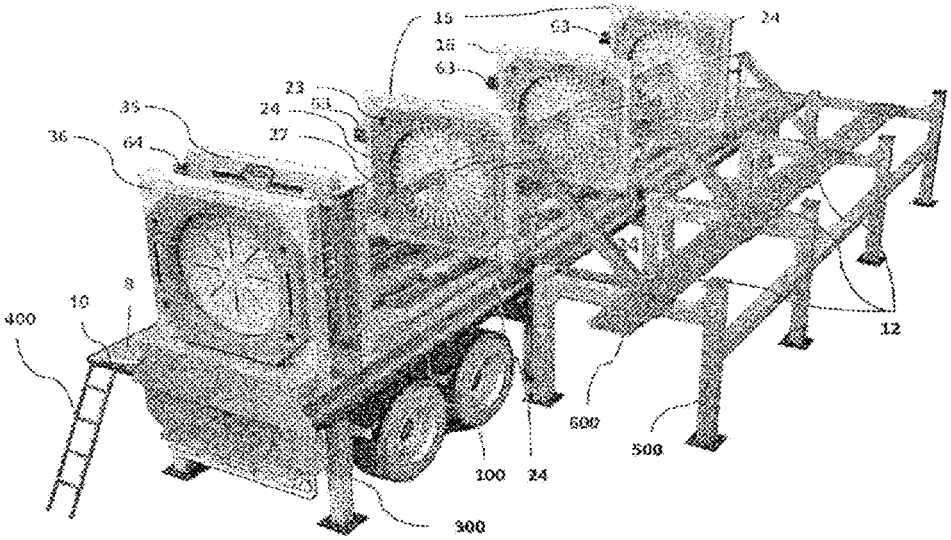
FIG. 5 shows the invented machine when it is ready to operate.

Arms (12), which one of them is shown in FIG. 4, are connected to the body of their adjacent feeding jaw ((15) or (16) at FIG. 5) by parts (13) and (14). Using two pivots provided in (13) and (14), the arms rotate around their fixed rod (17) up to 90 degrees and will be completely opened when becoming perpendicular to the trailer's longitudinal axis.

According to FIG. 5 after opening of arms (12), machine will be ready for loading. Supporting foundation (500) is carried near the machine by workers and longitudinal re-bars (600) are settled on it. Afterwards, the re-bars are directed to loading arms (12) for lifting up. It has been shown in FIG. 4 that arms (12) are equipped with two winches (18) and (19), which their center points are jointed to a slope side of frame (20). Two winches are linked by chain (21) and winch (18) is coupled with a motor. It's noteworthy that an encoder which is installed on motors coupled with parts (18) of every three arms (12) is responsible to synchronized movement of chains (21) of each arm.

Therefore, when longitudinal re-bars are located on chains (21), they will be lifted up. To prevent re-bars falling down from top of chains (21), several supports similar to (22) have been considered, and so undesired movement of re-bars has been restricted by them and can move upwards safely together with chain. Re-bars will leave the chains 21, when come to top of arms 12 and enter to feeding jaws frame ((15) and (16), seen in FIG. 5) from their grooves ((24) at FIG. 5) via ramp (23) which is connected to chassis (20).

Based on required reinforcing cage, the feeding jaws are designed in different shapes. According to FIG. 6, feeding jaw (15), as like as (16), has two main sections, frame (25), and rotary case (26). Center of case (26) of each jaw (two jaws (15) and middle one (16) in FIG. 5) is coupled with a triangular shaft (27). Rotation of this shaft causes turning case (26) inside its frame (25) as shown is FIG. 6.

Figure 6:
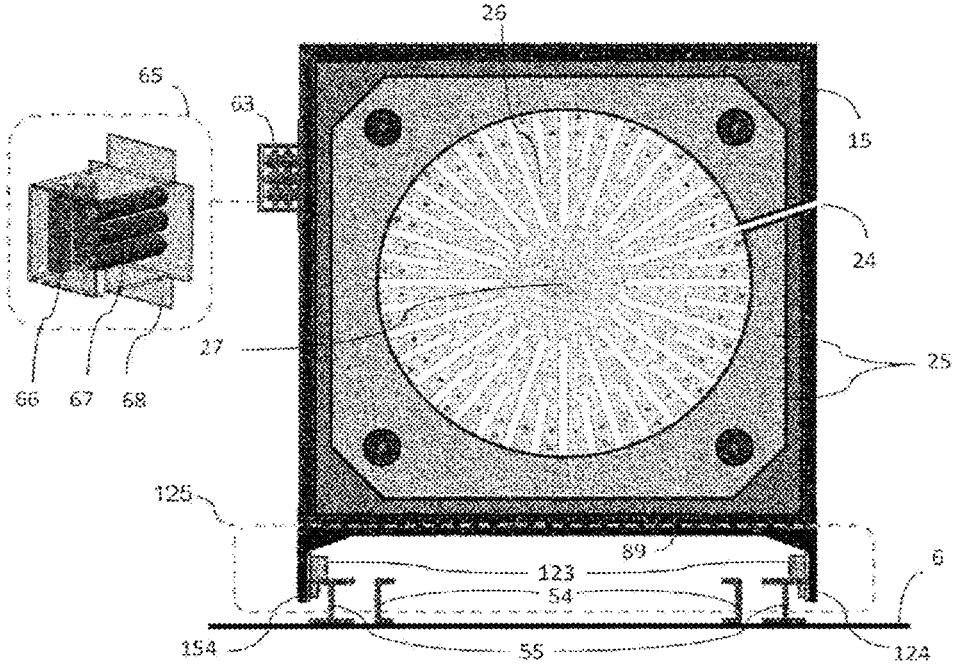
FIG. 6 is a front view of feeding jaws of invented machine
Figure 7:
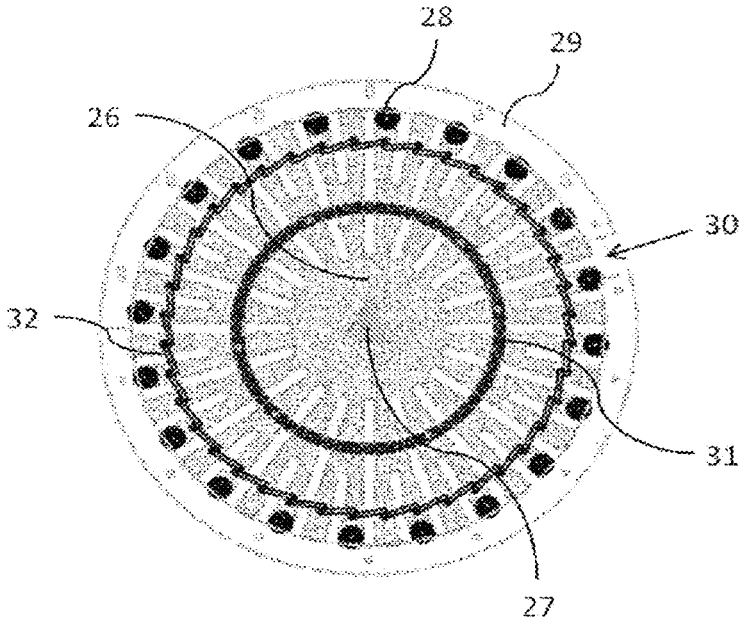
FIG. 7 is a rear view of rotating case of feeding jaw of the invented machine.

FIG. 7 also shows rotary case (26) without its main frame. Idler rollers (28) are located and connected to periphery of case (26) and rotate around guide (29) when shaft (27) turns. The guide (29) is jointed to frame ((25) in FIG. 6). Therefore, rotary case ((26) in FIG. 6) rotate into its frame ((25) in FIG. 6).

According to FIG. 7, when re-bars pass through grooves of frame ((24) in FIG. 6), they arrive at rotary frame (26) from section/opening (30) and settle/sit on ring (31). This ring is made of stainless steel. (Lack of such a ring, May cause re-bars to slide to the center of rotary case (26) which isn't desirable for manufacturing cages with big diameters, but for smaller cage diameters, ring (31) can be removed from rotary frame 26.

After loading each rebar, rotation of shaft (27) will rotate frame (26) to a necessary amount and machine gets ready to load the next bar. It is noteworthy that two automatic and manual modes are available, in which one the shaft (27) can be rotated. In this step, manual mode has been selected, and after loading each re-bar, the operator pushes a command button, and the shaft will rotate to a specific amount and the case (26) will get ready loading next bar.

Position of re-bars have already been loaded; will be changed after rotation of case (26). Re-bars in lower portion of frame, will get away from ring (31) due to the gravity, and get ready to exit from case (26). To control undesired exit, some safety lock have been considered all-around of case (26). One end of their safety locks (32) are pivoted to case (26) and the other end are free and rely upon the adjacent pivoted lock (32).

Safety locks are arranged according the FIG. 7, so when a re-bar enter the frame, free end of locks move aside, and re-bar is routed toward ring (31), but reverse action is impossible. When a re-bar become detached from ring, free end of lock engages with adjacent one and cannot open. Therefore, the re-bar has been blocked and cannot exit.

Figure 8:
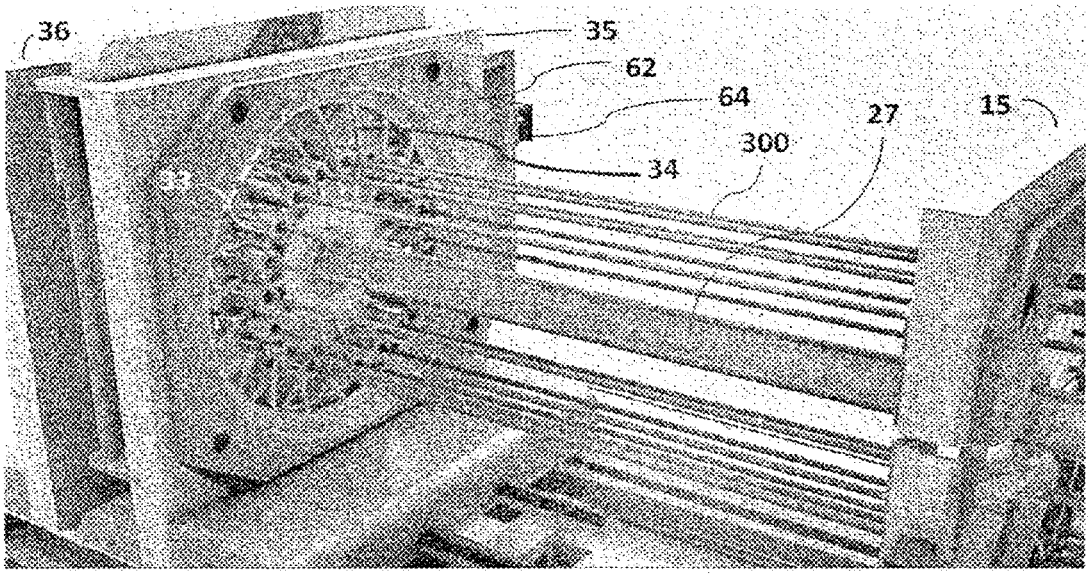
FIG. 8 shows the moving jaw of invented machine when the longitude bars are loaded.

As can be seen in FIG. 8, after a complete loading of re-bars, operator sends re-bars toward bushes (33) located on case (34) of moving jaw (35). Re-bars pass through the bushes (33) and will be sent to fixed jaw (36).

Figure 9:
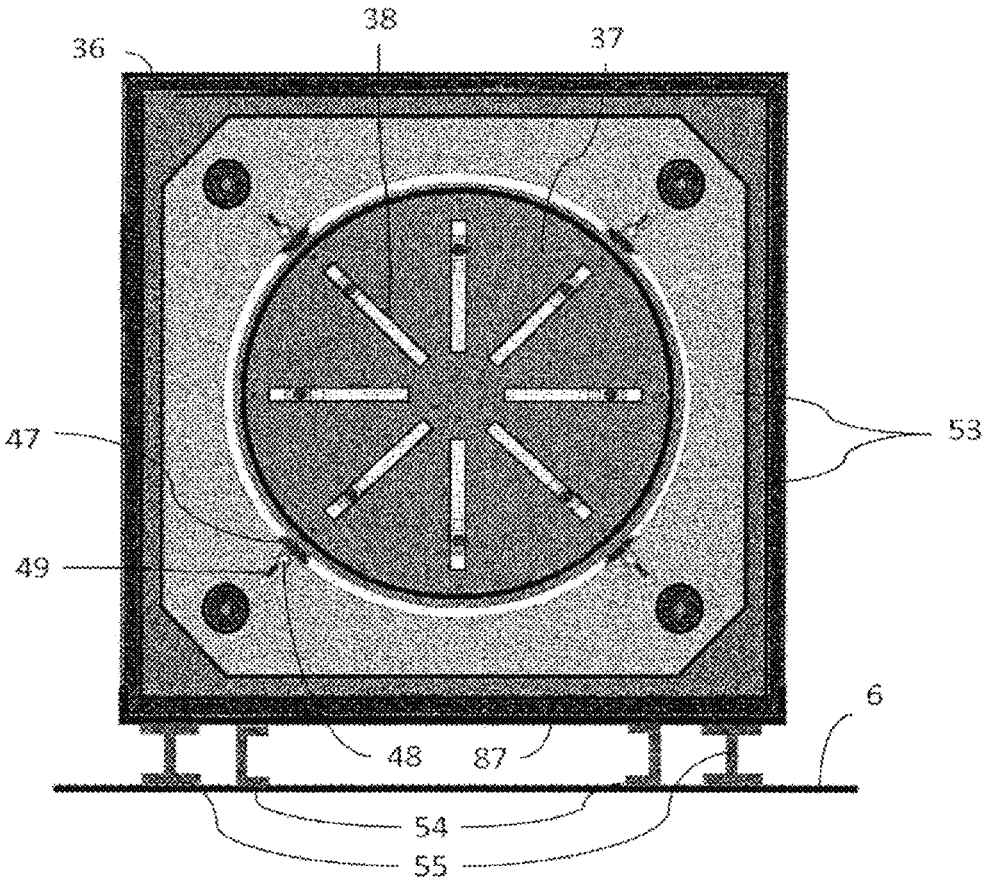
FIG. 9 is a front view of fixed jaw's case of invented machine.
Figure 10:
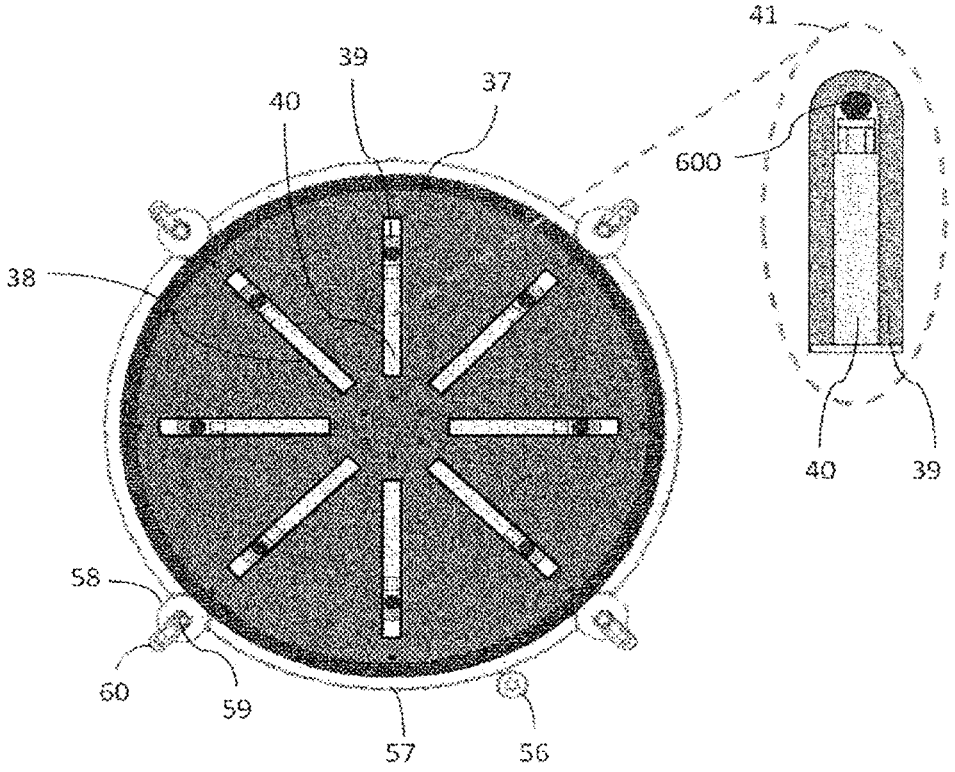
FIG. 10 shows the front view of fixed jaw's case of the invented machine when installed on the frame of fixed jaw.

FIG. 9 shows the fixed jaw of the machine where rotating case (37) in mounted on. Case (37), which is shown in FIG. 10, has eight grooves (38). Eight frames (39) are installed rear side of case (37) and along each groove (38); and eight hydraulic cylinders (40) are located on frames (39). (The frame (39) and their cylinders (40) have been shown in section (41), more clearly.

After embedding re-bars into fixed jaw ((36) in FIG. 8), they will be placed in grooves (38) between frames (39) and cylinders (40). Then hydraulic cylinders (40) will receive commands from hydraulic center of the machine and will activated to open, so re-bars (600) are located between frames (39) and cylinders (40), firmly. It is noteworthy that it is not necessary to fix all re-bars. In this case, only eight numbers of re-bars are kept firmly.

Figure 11:
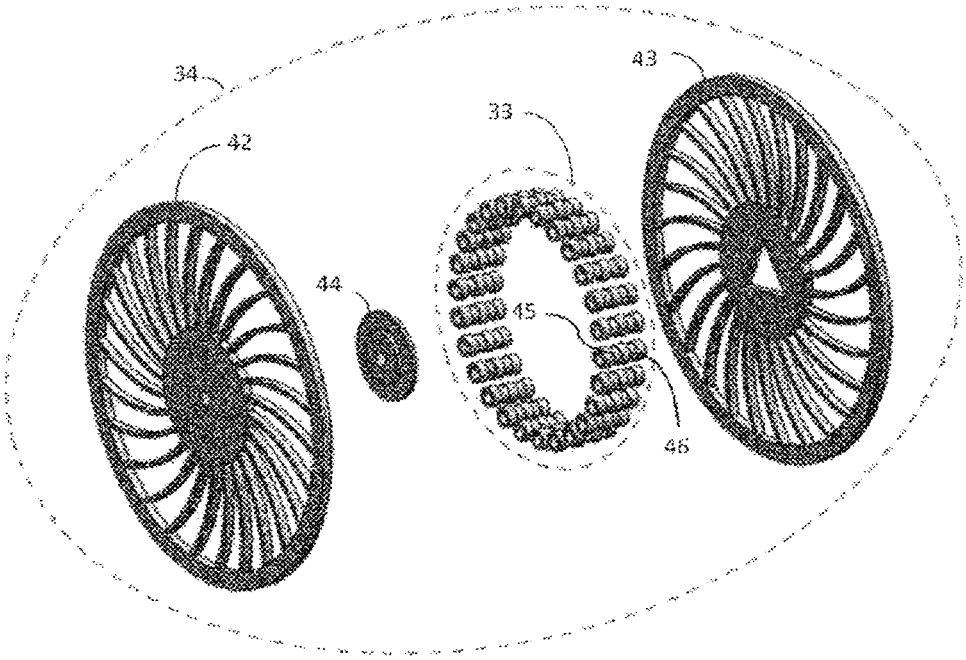
FIG. 11 illustrates elements of moving jaw's case of the invented machine.

According to FIG. 11, this shows the components of moving jaw's case (34), case (34) consist of two identical disks (42) and (43), that are placed on each other upside down, with a specific angle and coupled by a part (44). Therefore, few free spaces will be created between disks (42) and (43) and bushes (33) placed inside it and will be kept by them in a certain radial position. Hence, the shape of case (34) will be according to FIG. 12.

Changing the angle between disks (42) and (43) in FIG. 11, causes a change in space formed and moves all bushes (33) automatically. So bushes (33) will be kept by disks (42) and (43) at another radial position. Therefore, by very high precise altering the angle between disks (42) and (43), bushes (33) will be placed in desired radial position. Two grooves (45) and (46) have been considered on each of bushes (33). By embedding thickness of disks (42) and (43) inside grooves (45) and (46), either prevent longitudinal slide of bushes (33), or arrange easy and synchronized motion of bushes (33) on disks (42) and (43). Shaft (27) is coupled to disk (43).

Figure 12:
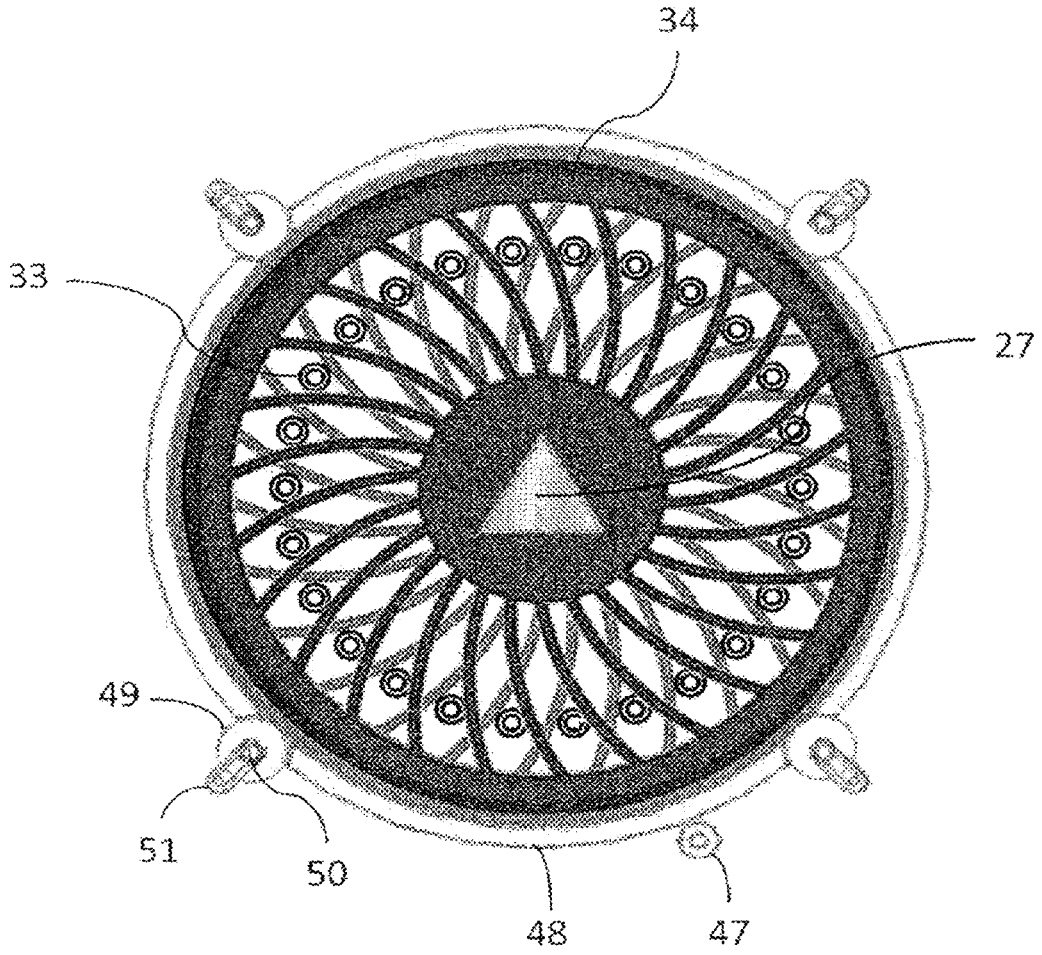
FIG. 12 shows the front view of moving jaw's case, when installed on the frame of moving jaw.

According to FIG. 12 that shows case ((34) in FIG. 8) of moving jaw ((35) in FIG. 8), to rotate case (34), an electrical motor has been utilized that is located inside of the frame of moving jaw ((35) in FIG. 8). Outer shaft of the gearbox of this motor (47) is engaged with a circular serrated plate (48). This plate is jointed to the frame (34). Thus, when the motor runs, the circular plate (48) and consequently the frame (34) will rotate. The frame (34) also is coupled to the shaft (27) so running the motor causes the rotation of the shaft (27) correspondingly. In order to turn the frame (34) and make it move easier, there are four freewheeling roller (49) which touch outer surface of frame (34). Shafts (50) of these rollers are located in grooves (51) on moving jaw ((35) in FIG. 8) and desired rotation of the frame (34) can be obtained by adjusting the gaps between the shafts (50) and the frame (34) and reducing friction.

Figure 13:
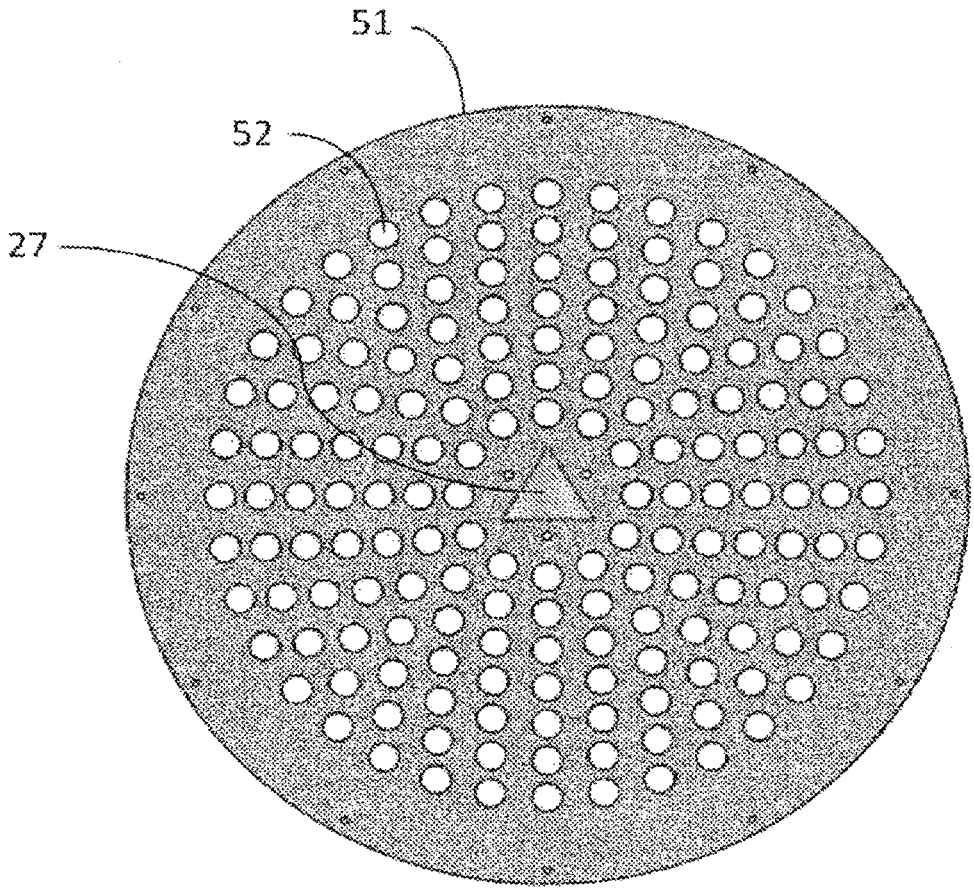
FIG. 13 shows another kind of moving jaw's case of the invented machine.

It is necessary to mention that based on desired shape of reinforcing cage, case of moving jaw ((35) in FIG. 8) with various forms can be replace with case (34) in FIG. 8. FIG. 13 shows another type of these cases. The case (51) has several holes (52), where stainless steel bushes ((33) in FIG. 8) are be placed into these holes (52), based on the shape and the dimension of reinforcing cage.

FIG. 9 shows the fixed jaw (36) of the machine, which its frame (53) has been secured on the longitudinal chassis (54) and (55). Case (37) rotates inside the frame (53). According to FIG. 10, case (37) equipped with an electrical motor with its gearbox (56), turn plate (57), and consequently case (37). It is noteworthy that the rotating speed of case (37) frame is equal to speed of the moving jaw's case ((34) in FIG. 8). In FIG. 10, the fixed jaw has some freewheeling rollers (58) which their shafts (59) are located in groove (60).

On next step, stirrup reel is placed on the winch (3) as it is shown in FIG. 2. Winch (3) has a chassis (61) where reel is located on it and column (62). This chassis with special shape acts as a peripheral protector for stirrup reel. The column (62) is coupled to an electrical motor, which turns winch (3), and stirrup wire is opened.

Figure 20:
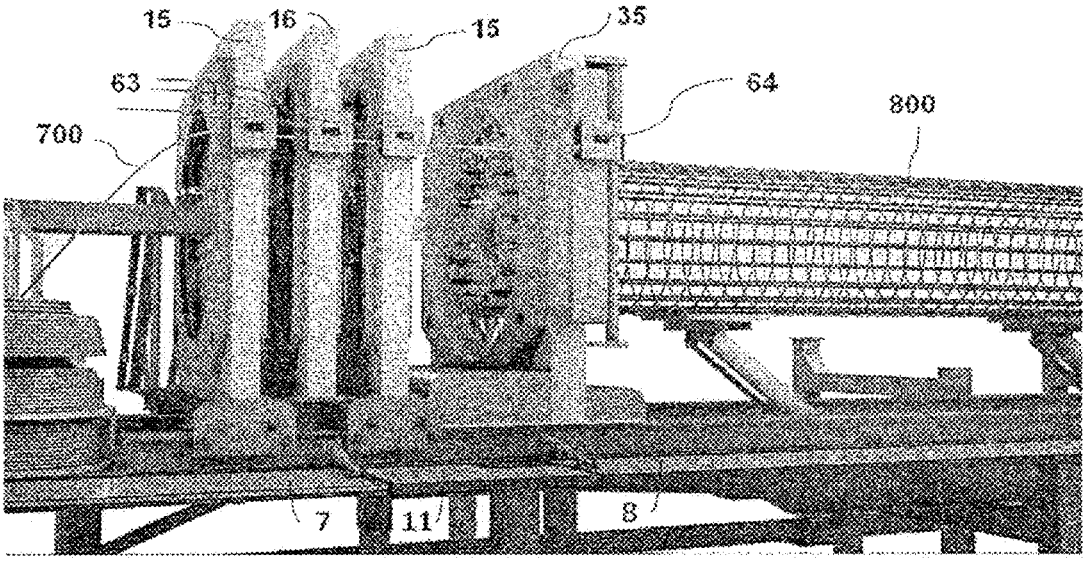
FIG. 20 shows the feeding and moving jaws of the invented machine in resting mode.

After inserting stirrup reel on winch (3), the steel wire will pass through 3 guides (63) and the other guide (64) according to FIG. 1. (In FIG. 20 stirrup reel have already passed through guides (63) and (64)). Guide (63) which is shown in FIG. 6 can be seen in section (65) with more details. Guide (63) has two vertical rollers (66) and three horizontal rollers (67) which are mounted on frame (68). Frame (68) is shown transparently in section (65). Guide (64) in FIG. 1 is also similar to guide (63) but connected to moving jaw (35).

In FIG. 6 stirrup passes through vertical rollers (66) and afterwards three horizontal rollers (67). Passes of three horizontal rollers (67), make simultaneous passing of two stirrups possible which this mechanism can be used to weave double stirrup cages.

Figure 14:
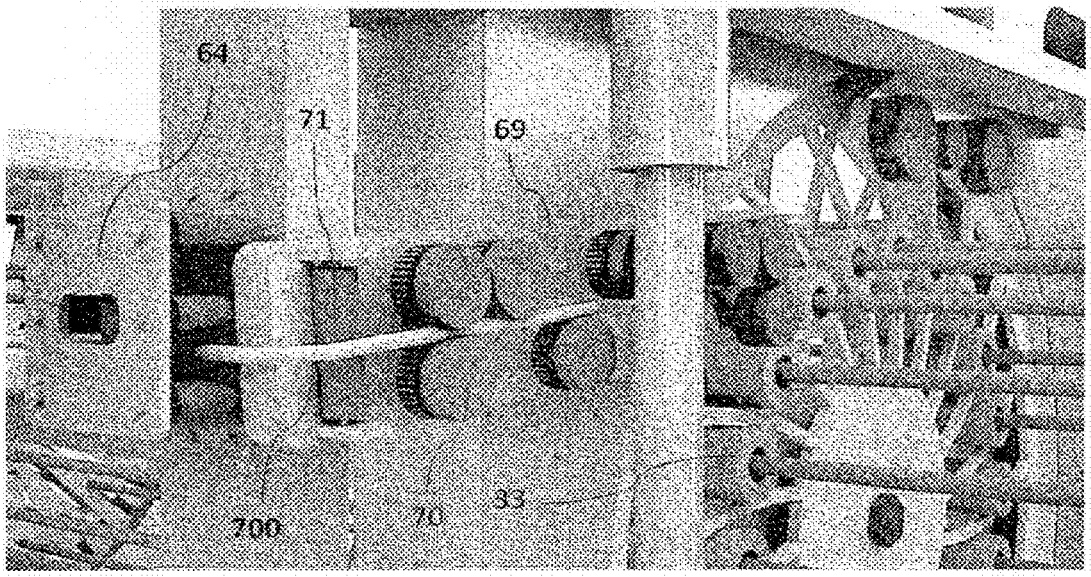
FIG. 14 shows the stirrup guide mounted on the moving jaw.

According to FIG. 14, stirrup (700) enter guide (69) after passing guide (64). Guide (69) has two types of rollers (70) and (71).

Figure 15:
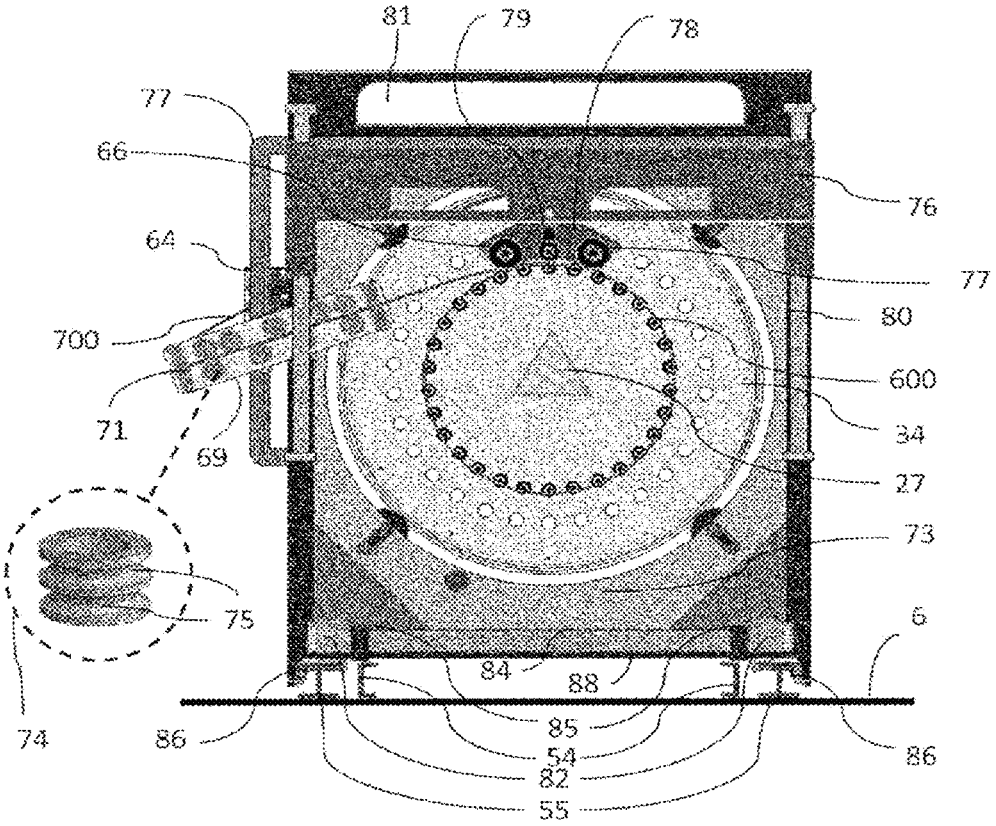
FIG. 15 shows front view of the moving jaw of invented machine.

FIG. 15 shows moving jaw (35) where the guide (69) is placed on arm (72) connected to frame (73). Two rollers of type (71) which are installed at inlet and outlet of guide (69), adjust the height of stirrup (700) to touch rollers type (70) effectively. Passing through freewheeling rollers (70), also causes undesired bending of stirrups (700), and prevents probable corrosion. It is noteworthy that the guide (69) equipped with two electrical motor, which can be adjusted in both height on arm (72) and angle. This cause the stirrup (700) wire mounted on re-bar in the best possible angle according to shape of dimension of reinforcing cage.

At present, concurrent rotation of motor and gearboxes of fixed and moving jaws ((56) in FIG. 10 and (47) in FIG. 12 respectively), causes simultaneous turn of frames of fixed, moving and feeding jaw ((37) in FIG. 10, (34) in FIG. 12 and (26) in FIG. 6, respectively). Therefore, loaded re-bars mounted on these frames rotate consequently. In addition, rotation of stirrup reel winch ((3) in FIG. 2) feeds more steel wires.

In FIG. 15 when stirrup wire (700) lies on re-bars (600), robot (76) with its freewheeling rollers (77) installed on arm (78) prevents wire from sliding, so welder roller (79), welds stirrups on re-bars. This roller is made of copper or other heavy duty conductors. After physical contact between rollers (77) and the cage during rotation and an intelligent recognition of contact intersection of stirrup (700) and re-bar (600), by vision sensor, welding action will be done. (In case of $CO_2$ welding, this roller is removed and replaced by a $CO_2$ torch holder).

It's essential to mention that the invented machine equipped with a finger touch monitor which enable the operator to control various parameters of machine, for instance required pitch internals of stirrup. Central control system of invented machine can produce different stirrup pitch interval by controlling rotational speed of jaws and longitudinal speed of moving jaw.

Two electrical motor have been consider for robot (76) one of them moves robot up and down on the arms (80) and another one changes the angle of arm (78) and corresponding entrance angle of robot on stirrup. It is necessary to note that the power supply of welders is placed in a case (81).

According to FIG. 13, displacement of moving jaw (35) on frame (55) and getting away from fixed jaw (36) will complete the sequences of production of reinforcing cage.

Figure 17:
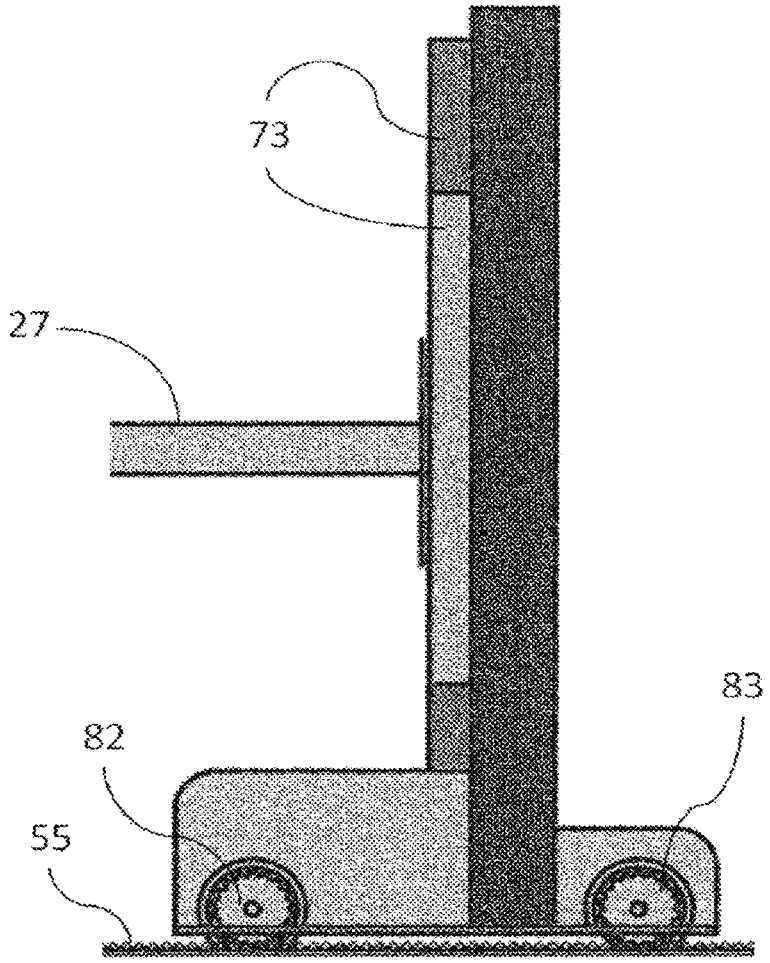
FIG. 17 is a lateral view of moving jaw of invented machine.

FIG. 17 illustrates lateral view of moving jaw (35) in a simple form. As can be observed, the moving jaw is mounted on a couple wheels (82) and (83) and move as will be describe in FIG. 18. Wheels (82) and (83) have teeth like a gear and rolling on serrated chassis (55) causes the non-slip motion. According to FIG. 15, shaft (84) is jointed to wheels (82) and rotates inside ball bearings (85) connected to frame wall. Furthermore, two free wheels (86) is connected to wall of moving jaw frame and contacted with underneath surface of chassis (54), to maintain more stability and easier movement of jaw.

Figure 16:
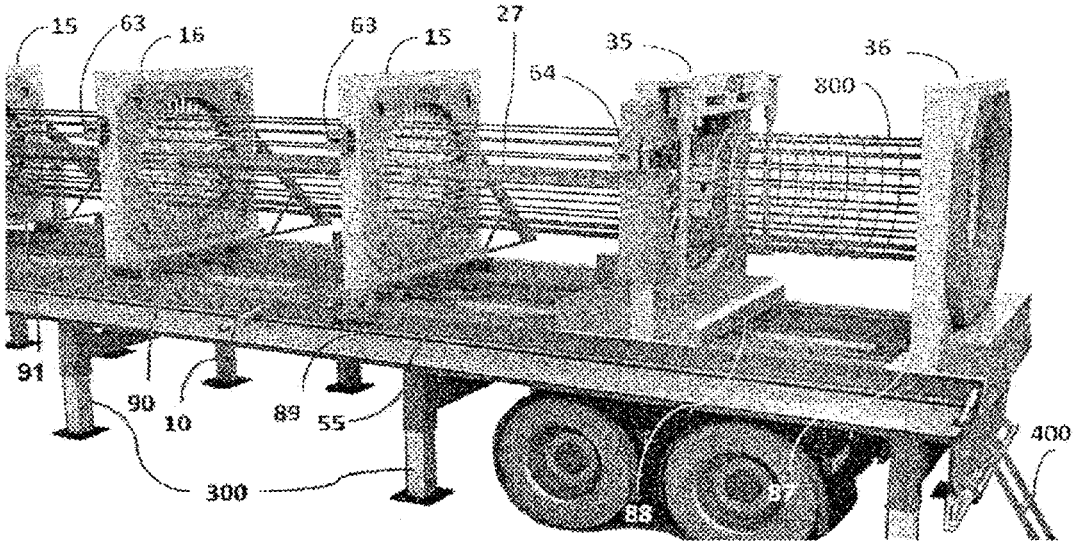
FIG. 16 shows the invented machine while producing a reinforcing cage.
Figure 18:
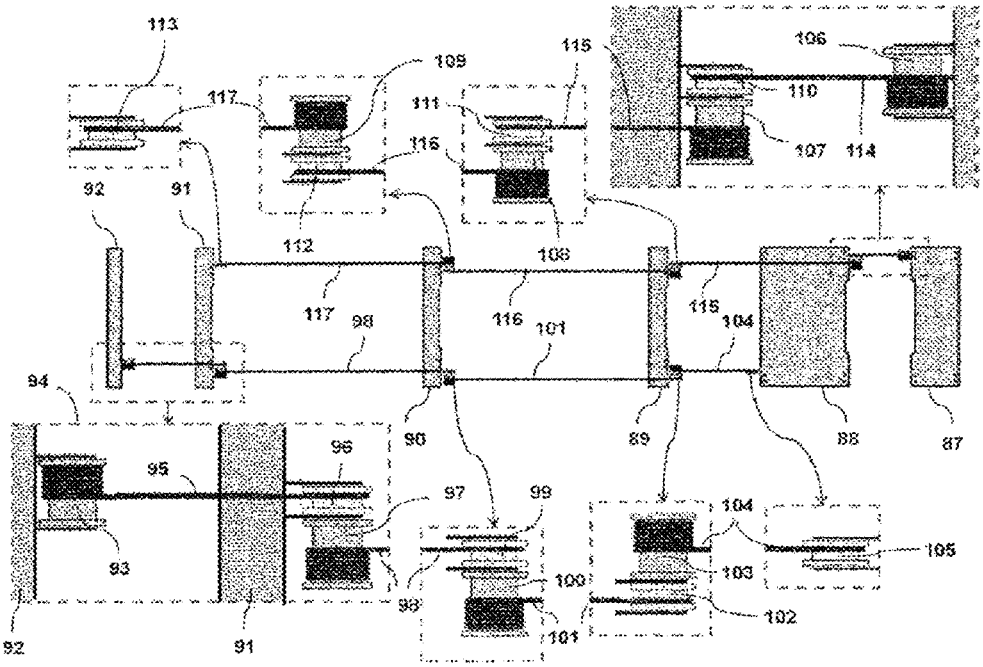
FIG. 18 shows top view of the movement system of moving and feeding jaw.

As it clear in FIG. 16, when moving jaw (35) moves apart fix jaw (36), will come nearer to feeding jaws (15). Therefore, continuity in movement of jaw (35), necessitating feeding jaw (15) gets away from fixed jaw (36) and prepares proper space for movement of jaw (35). Certain mechanism as shown in FIG. 18 has been utilized for movement of moving jaw ((35) in FIG. 16) and feeding jaws ((15) and (16) in FIG. 16).

In FIG. 16, parts (87) and (88) are the lower plate of fixed jaw (36) and moving jaw (35) and parts (89), (90) and (91) are the lower plate of feeding jaws (15) and (16). Top view of plates (87) to (91) are seen in FIG. 18. More over part (92) is the ending section of main chassis ((6) in FIG. 2). To move moving and feeding jaws ((35), (15) and (16) in FIG. 16) apart from fixed jaw ((36) in FIG. 16), winch (93) is applied which is coupled to an electrical motor. Winch (93) which is connected to part (92), can be seen more clearly in section (94).

The opposite side of cable (95) which is laid on winch (93), is rolled around freewheeling pulley (96) and connected to plate (91). When the motor coupled to winch (93) rotates, winch (93) turns and pulls cable (95). Therefore, plate (91) is pulled toward part (92) due to tension of cable (95) and consequently freewheeling pulley (96) will be rotated.

Rotation of pulley (96) will turn coupled winch (97) and turning of winch (97) makes tension in cable (98) which is around freewheeling pulley (99), and connected to plate (90). This tension causes the plate (90) moves toward part (92). In a same manner, freewheeling pulley (99) turns winch (100) and tension of cable (101) which is around pulley (102) and connected to plate (89), leads to movement of plate (89) toward part (92). Similar events occurs for movement of plate (88) toward part (92), when freewheeling pulley (102) turns winch (103) and makes tension of cable (104) passed through pulley (105) and connected to plate (88). Hence, approaching plates (88), (89), (90), and (91) to part (92) and getting away from part (87), moving jaw ((35) in FIG. 16) and feeding jaws ((15) and (16)) in FIG. 16) move away from fixed jaw ((36) in FIG. 16).

To reset the invented machine to its initial position, feeding jaws ((15) and (16) in FIG. 16) and moving jaw ((35) in FIG. 16) must come nearer to fixed jaw ((36) in FIG. 6) with a similar procedure have been already presented. In other words, a motor coupled to winch (106), together with winches (107), (108), (109) and freewheeling pulleys (110), (111), (112), and (113), make necessary tension in cables (114), (115), (116), and (117). Therefore, plates (88), (89), (90) and (91) and consequently moving jaw ((35) in FIG. 16) and feeding jaws ((15) and (16) in FIG. 16) are moved.

Figure 19:
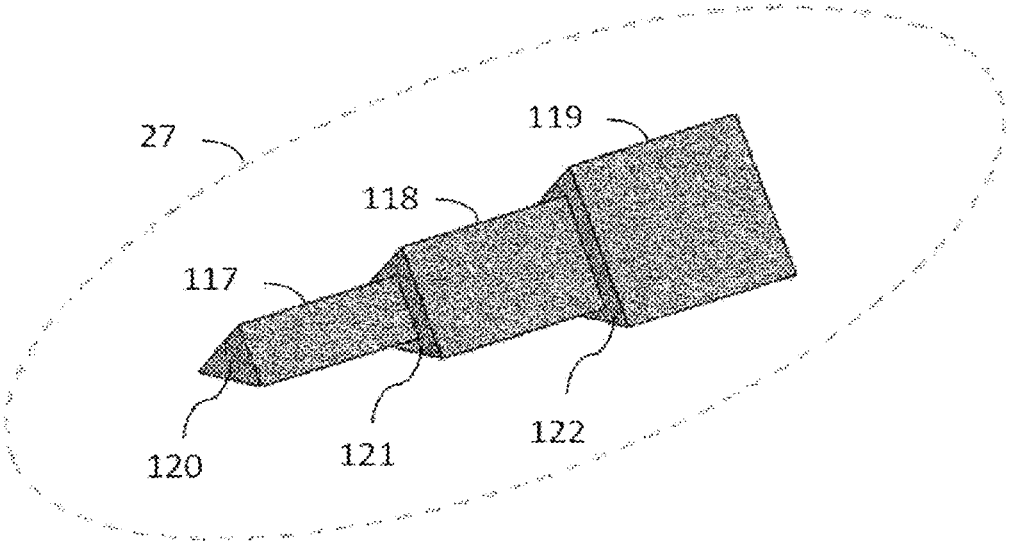
FIG. 19 represents the three dimensional view of main shaft of machine.

For displacement of jaws, the length of shaft (27) should be changed. To this, as can be seen in FIG. 19, triangular shaft (27) is formed by three portions with three different cross sections (117), (118) and (119). In this figure, portions with cross sections (120), (121) and (122) are connected to moving jaw ((35) in FIG. 16), its adjacent feeding jaw ((15) in FIG. 16) and middle feeding jaw ((16) in FIG. 16), respectively.

Portion (117) is freely placed in part (118), (118) freely inside (119), and portion (119) is freely located in feeding jaw frame contiguous with winch (jaw (15) adjacent to (3) in FIG. 2). In this manner after movement of moving jaw ((35) in FIG. 16), going (117) inside (118), portions (117) and (118) inside (119) and sending (119) out of frame of feeding jaw near the winch (jaw (15) adjacent to (3) in FIG. 2); shaft (27) will shorten telescopic as it can be seen in FIG. 20 and the reinforcing cage will be formed as it can be seen in FIG. 21.

Movement of moving jaw ((35) in FIG. 16) done by a pair of toothed wheels (123), at both sides of frame (55), see FIG. 6. For a better stability of feeding jaws also a pair of free wheeling (124) are utilized, which are contacted by lower surface of frame (55).

Figure 22:
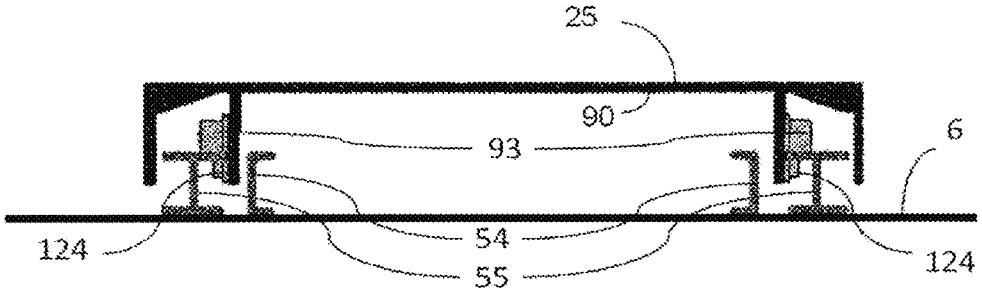
FIG. 22 illustrates the foundation of middle feeding jaw of machine.

Its noteworthy that for a complete shrinking of three feeding jaw ((15) & (16) in FIG. 1), the stand of middle feeding jaw ((125) in FIG. 6 for two other feeding jaw), is designed according to FIG. 22, and the wheels are contacted with them on the other side of frame (55). (It also can be seen in FIG. 20)

Figure 21:
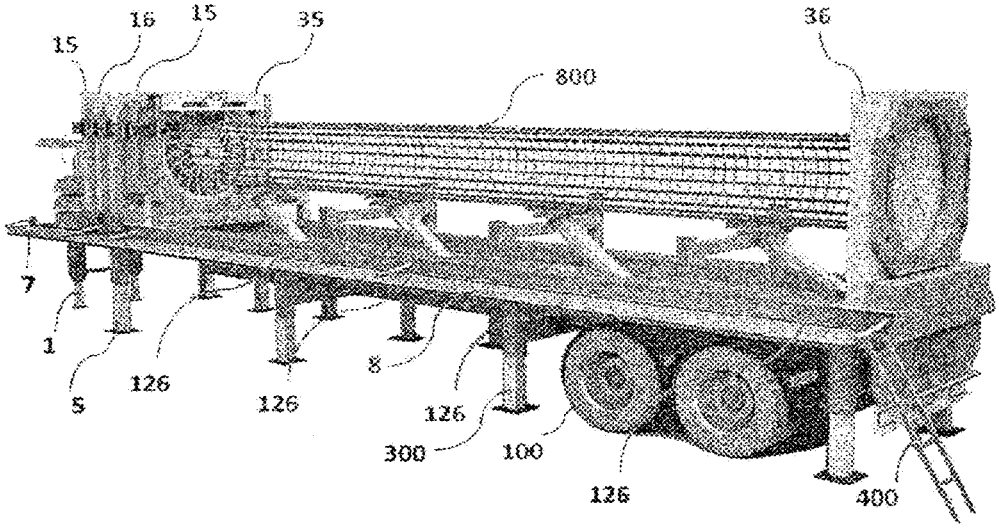
FIG. 21 shows the invented machine when the cage is made.

According to FIG. 21, to prevent undesired bending of reinforcing cage (800) under construction, four supporting cylinders (126) with a three meters pacing are used. These cylinders are expanded in FIG. 21. Cylinders (126), are placed on the main chassis ((6) in FIG. 2) of machine in closed form, before moving jaw ((35) in FIG. 21) passes them, see FIG. 2, and will be opened after moving jaw ((35) in FIG. 21).

Figure 23A:
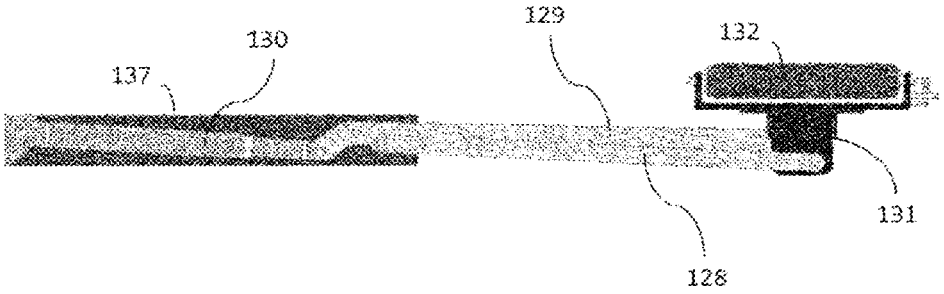
FIG. 23A shows supporting cylinder of invented machine in open position.
Figure 23B:
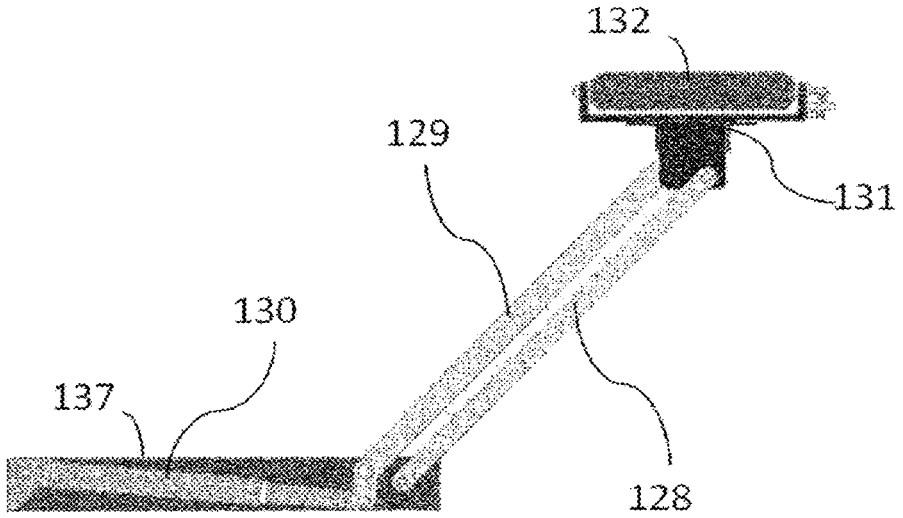
FIG. 23B shows supporting cylinder of invented machine in close position.

FIG. 23A shows cylinders ((126) in FIG. 21) when are closed. These cylinders which are connected to main chassis ((6) in FIG. 2) of machine from section (127), has two arms (128) and (129) and as illustrated on FIG. 23B, can go upward when hydraulic cylinder (130) expands, so the frame (131) will be lifted up. A pair of rollers (132) is mounted on this frame.

Figure 24:
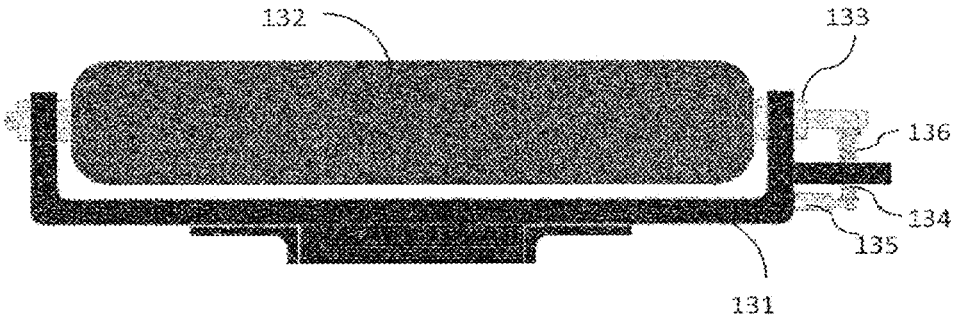
FIG. 24 represents the rollers of hydraulic cylinder of invented machine.

These rollers are made of stainless steel, which can be turned freely under rotating reinforcing cage ((800) in FIG. 21). The movement of arms (128) and (129) are in such a way that position of rollers (132) always are kept horizontally. After expanding cylinder (130) and when rollers (132) touch reinforcing cage under construction ((800), in FIG. 21), the shaft (133) will go down inside grooves on frame (131), see FIG. 24, and will trigger a limit switch (135) by arm (104).

This switch is responsible to control the height of cylinder by means of keeping reinforcing cage ((800) in FIG. 16)

horizontally in entire period of cage construction process, by applying necessary force of rollers (132) to power portion of cage. It is necessary to mention that spring (136) is applied to keep arm (134) in neutral status.

The invention claimed is:

1. A portable, compact and automated cage making machine mounted/sitting on top of a flat trailer; wherein said machine comprises:

a main chassis; at least four stands wherein each stand comprises a hydraulic cylinder; wherein said at least four stands are attached at the bottom of said main chassis; wherein when said trailer is at a specific and desired location a central hydraulic system activates said stands, therefore said at least four cylinders of said at least four stands touch the ground and said machine is detached from said trailer in a fixed and stationary position;

said machine further comprises three loading arms that are parallel to longitudinal axis of said trailer in a closed form and will completely be in an open position and ready to receive/load longitudinal re-bars, when they rotate up to 90 degrees with respect to said longitudinal axis;

wherein each one of said loading arms comprises two perpendicular side arms fixedly attached to one another and said main chassis via a connecting and rotating joint; and wherein said side arms on their other end comprise a winch, wherein said winches are connected to each other via a chain and one of said winches is coupled to a motor; wherein said chain comprises multiple projections protruding out from said machine; wherein said machine further comprises three feeding jaws placed along said longitudinal axis of said trailer at a specific distance from one another and each in contact with one of said loading arms respectively; wherein said multiple feeding jaws comprise a same width as said trailer and are designed in different shape creating different reinforcing cages as needed.

2. The machine of claim 1, wherein said feeding jaws comprise: two main sections, a frame and a rotary case; wherein said groove is diagonally starts from an outside edge of said frame and ends towards said rotary case; and wherein each one of said at three feeding jaws comprise a shaft at it center, wherein a rotation of said shaft turns said rotary case inside said frame.

3. The machine of claim 2, wherein said rotary case further comprises multiple idler rollers, located and connected to a periphery of said rotary case and rotate inside a guide when said shaft turns; wherein said guide has a diameter larger than said rotary frame and is connected to said frame.

4. The machine of claim 3, wherein during said receiving/loading, said longitudinal re-bars are located on a supporting stand separate placed close to and having a same height as said machine when said stands are fixedly attached to the ground; and wherein said each one said loading arms comprises a ramp connected to one of said winches coupled to said motor.

5. The machine of claim 4, wherein said longitudinal re-bars are placed on said chain they will be lifted up from said supporting stand and move on said chain towards said machine via said projections; wherein said projections prevent any unwanted movement of said longitudinal re-bars; and help with guiding said longitudinal re-bars towards said ramp and unloading them into a groove of each one of said feeding jaws.

6. The machine of claim 5, wherein said rotary case comprises multiple fissures slanted towards said shaft at said center but do not reach said shaft; and wherein each one of said fissures comprises a ring located at a distance away from an end section of said fissure towards said shaft; wherein said longitudinal re-bars pass through said groove and arrive at said rotary case from an opening of said rotary case and sit on one of multiple rings; and wherein for making said reinforcing cages having small diameters said multiple rings will be removed and not needed.

7. The machine of claim 6, wherein after each one of said longitudinal re-bars are loaded inside said rotary case and fixed next to said multiple rings, said shaft is rotated and therefore another one of said fissures adjacent to the one having said longitudinal re-bar will face said opening of said rotary case and ready to receive another one of said longitudinal re-bars.

8. The machine of claim 7, wherein said rotary case further comprises multiple one-way safety locks at an open end of each one of said fissures; wherein each one of said longitudinal re-bars enter each one of said fissures by passing and opening said one-way safety lock, and by each rotation of said rotary case said one-way lock prevents said loaded longitudinal re-bars from exiting said rotary case.

9. The machine of claim 8, wherein said machine further comprises a moving jaw and a fix jaw, located towards a bead/proximal end of said trailer and comprises similar shape and structure as to said multiple feeding jaws; wherein said moving jaw is adjacent to said multiple feeding jaws and said fixed jaw is located the very end of said head; and wherein said moving jaw further comprises multiple bushes located in its respective rotary case and when said longitudinal re-bars are fully loaded on all of said three feeding jaws, said longitudinal re-bars will be guided inside said multiple bushes and sent to said fixed jaw.

10. The machine of claim 9, wherein said fixed jaw comprises multiple closed ended fixed grooves placed around a center of said fixed jaw and each one of said fixed grooves comprises a fixed frame and a cylinder; wherein same number of said longitudinal re-bars as said fixed groves will be firmly placed between said fixed frame and said cylinder.

11. The machine of claim 10, wherein said rotary case of said moving jaw further comprises of two identical disks each having curved and slanted fissures; and wherein said identical disks are placed on top of one another with their respective curved and slanted fissures crisscrossing each other, wherein said multiple bushes are located in spaces created by this crisscrossing position and by rotation of one of said identical disk with respect to the other one, an arrangement of said multiple bushes changes and therefore a final shape of said reinforcing cage created by said longitudinal re-bars will change as well.

* * * * *